United States Patent [19]

Almond

[11] 4,362,940

[45] Dec. 7, 1982

[54] ZERO DISPLACEMENT IONIZATION CHAMBER

[75] Inventor: Peter R. Almond, Houston, Tex.

[73] Assignee: Board of Regents, University of Texas Systems, Austin, Tex.

[21] Appl. No.: 144,840

[22] Filed: Apr. 29, 1980

[51] Int. Cl.[3] ..... H01J 39/28

[52] U.S. Cl. ..... 250/374; 250/252.1

[58] Field of Search ..... 250/252, 374, 375

[56] References Cited

U.S. PATENT DOCUMENTS 2,536,991 1/1951 Wollan et al. ..... 250/374

OTHER PUBLICATIONS

Sauret-Cistac et al., "A High-Sensitivity Balloon-Borne Tissue Equivalent Proportional Counter", Nuc. Instr. & Methods, 129(5), Nov. 15, 1975, pp. 607-612.

Stark et al., "Design and Use of Zero Displacement Tissue Equivalent and Air Equivalent Ionization Chambers", Med. Phys. 6(4), Jul./Aug. 1979, p. 332.

Stark, "Design and Use of Zero-Replacement Tissue--Equivalent, and Air Equivalent Ionization Chambers", Thesis, U. of Texas, Houston, Oct. 1979.

*Primary Examiner*—Alfred E. Smith
*Assistant Examiner*—Carolyn E. Fields
*Attorney, Agent, or Firm*—Arnold, White & Durkee

[57] ABSTRACT

The present invention provides a zero displacement ionization chamber for use in calibrating radiation units. The ionization chamber includes a thimble chamber having first and second electrodes with predetermined thickness and length separated from one another by a pre-defined air gap. The material density and air gap density are balanced by weighting the normal path lengths of radiation rays through the thimble chamber, thereby affecting the thimble chamber having an overall density substantially the same as water thus yielding a zero displacement when placed in water. The first and second electrodes are further electrically connected to a power source for creating an ionization effect when receiving radiation rays in the air gap so that a signal indicative of the radiation exposure may be detected by an electrical connection to one of the electrodes.

13 Claims, 3 Drawing Figures

ZERO DISPLACEMENT IONIZATION CHAMBER

BACKGROUND OF THE INVENTION

This invention relates to an ionization chamber for calibrating radiation units and more specifically to a zero displacement ionization chamber.

Radiation therapy has become well known and its use widespread for treating cancer. In many instances, the radiation machines used in this treatment produce doses of x-rays or gamma rays. An example of a radiation machine used for this treatment is a Cobalt-60 teletherapy unit.

As in any radiation exposure to a patient, the dose given during any one particular treatment is critical. The criticality is more than just a problem of overexposure but in cancer patients, for example, the problem of underexposure is just as dangerous. Overexposure of radiation treatment will provide side-effects over and beyond the killing of cancer cells. Underexposure may provide only temporary relief of the cancer growth while leaving part of the cancerous tissue to later cause the patient problems. Therefore, accuracy of dosage is a critical parameter in this type of treatment.

Since dosage is critical, it has become common practice in radiation therapy to have periodic calibration of the teletherapy machines. This calibration is traditionally performed by using an ionization chamber. The use of the ionization chamber includes placing the chamber either in a water phantom or in air and directing the radiation machine at the ionization chamber to expose the chamber to gamma or x-rays. This exposure induces an electrical signal in the chamber which is indicative of the dosage received by the phantom. More specifically, the ionization chamber comprises two electrodes separated by an air gap with a high electrical potential difference between them. Exposure by x-ray or gamma rays causes ionization of air resulting in negative and positive ions that gravitate to the electrode having an opposite polarity. Thus, a current is induced which is proportional to the radiation received. This current is in turn monitored by an appropriate meter and can be related to the patient dose. This dose can then be compared to the actual setting of the radiation machine.

The calibration procedures may be performed in a water phantom which simulates a patient for purposes of detecting the dosage of radiation that would be received by a patient under actual therapy conditions. Water has been found to be an equivalent tissue substitute for this purpose, however, Cobalt-60 machines can be calibrated by measurements in air and related to the patient dose by calculation. The International Commission on Radiation Units and Measurements and other groups recommend that calibrations should be accomplished at 5 cm depth in a water phantom. A complete discussion of comparisons between water phantom and in-air calibrations may be found in an article by W. H. Grant, III et al entitled "Calibration in Water Versus Calibration in Air for Colbalt-60 Gamma Rays", Medical Physics, Vol. 4, No. 1, January/February 1977.

Research in the area of calibration using a water phantom has identified a calibration error when using state of the art ionization chambers for Colbalt-60 machines. In the overall calibration of the radiation machines there are many parameters that need be considered to accurately determine the radiation dosage supplied by that machine. It has been established that the calibration factors for therapy machines can be divided into chamber-dependent and chamber-independent components. A discussion of the relevance of the chamber-dependent factors may be found in an article by P. R. Almond et al., entitled "Ionization-Chamber-Dependent Factors for Calibration of Megavoltage X-Ray and Electron Beam Therapy Machines", International Symposium on National and International Standardization of Radiation Dosimetry, Atlanta, Georgia, December 1977. One such factor is the displacement factor which depends upon thickness of the chamber wall, chamber wall composition, size of the chamber and the center electrode. When using the ionization chamber in water, all of these factors influence the displacement factor. It has been found that a calibration error of up to 3% can occur if this factor is ignored.

In a typical treatment of a cancer patient, a normal dose might be 6,000 rads over a six-week treatment period. For proper treatment of the patient, it is often necessary to accurately establish the exact amount of radiation received during any one treatment so that subsequent or follow-up treatment may be analyzed. In many of the Colbalt-60 teletherapy machines, the radiation exposure rate approaches 100 rads per minute, and an error rate in the vicinity of 3% is not acceptable, as discussed by R. Golden et al. in Cancer, Vol. 29, 1972, page 1468.

Theoretically, when the ionization chamber is placed in water, the water is simulating the tissue of the patient and the purpose of the calibration is to effectively measure the dosage that would be received by a patient as stated above. However, since the radiation rays are attenuated at a different rate in water than through the ionization chamber with an air gap which has substantially zero attenuation, there cannot be a true reading of the actual dosage received by the water phantom. The difference between the absorption path lengths in the water phantom and ionization chamber has been labeled missing phantom material since the ionization chamber has in effect displaced some of the phantom material.

SUMMARY OF THE INVENTION

The present invention provides an ionization chamber for calibrating radiation therapy machines. The ionization chamber is materially and structurally balanced to effect a zero displacement when used in a water phantom. Thus, use of the ionization chamber of the present invention eliminates the need for reconciling the displacement factor in calculating the actual dose from a radiation therapy machine when calibrated in a water phantom.

The ionization chamber of the present invention includes a probe-like apparatus having a thimble chamber for detecting radiation and generating an electrical signal indicative of the amount of exposure to the water phantom. The thimble chamber includes a first outer electrode having a predetermined thickness and length constructed of a conducting plastic and making up the wall of the thimble chamber. A second center electrode is also provided located in the center of the thimble chamber and spaced from the first electrode by a predefined air gap. The material of the second electrode is also capable of conducting electricity. The thickness of both the first and second electrode are adapted to yield an overall chamber density when combined with the air gap, substantially equal to the density of water. The density and dimensional relationship of the electrodes is accomplished by weighting the normal radiation path lengths to the chamber such that there is a zero missing water phantom. With the density of the chamber substantially the density of water, the ionization chamber effectively has a zero displacement when submerged in water, i.e., a displacement factor of unity.

In the preferred embodiment of the ionization chamber of the present invention, the first and second electrodes comprise conductive plastic materials such as tissue equivalent A-150 plastic or air equivalent C-552 plastic where the C-552 plastic has an effective density of 1.76 gm/cm$^3$. With the density of the conductor material greater than water and the air gap less than water, substantially zero, the average weighting of the radiation rays will produce no missing phantom material and thus an equivalent zero displacement in water. The preferred embodiment of the zero displacement ionization chamber provides for an outside electrode having a length approximating 1.6 centimeters and a width approximating 0.22 centimeters. The outer radius of the thimble chamber approximates 0.50 centimeters with an inner radius of 0.28 centimeters and a center electrode radius of 0.1 centimeters.

BRIEF DESCRIPTION OF THE DRAWINGS

Other features and advantages of the present invention will become apparent from the following detailed description and further in view of the drawings in which.

DETAILED DESCRIPTION OF THE INVENTION

Figure 1:
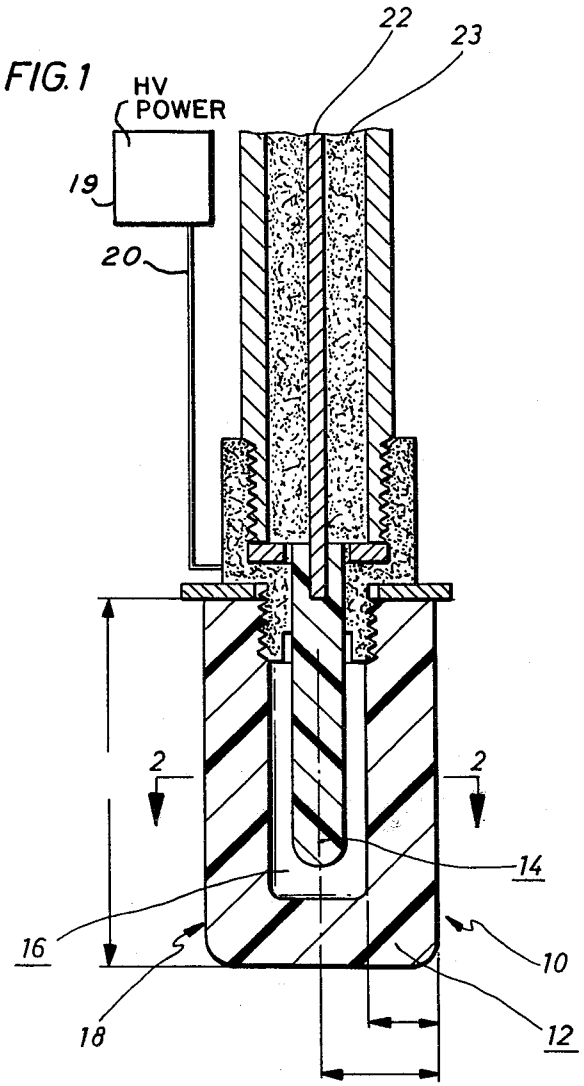
FIG. 1 is a side view of an ionization chamber having a zero displacement in a water phantom in accordance with the present invention.

Referring now to the drawings and more particularly to FIG. 1 where a zero displacement ionization chamber 10 is illustrated. The ionization chamber 10 includes a pair of electrodes 12 and 14. The electrodes in the preferred embodiment 12 and 14 are fabricated of an air equivalent material. The material making up the electrodes 12 and 14 is a conducting plastic such as air equivalent C-552 plastic. The C-552 plastic is air equivalent and has a density of 1.76 gm/cm$^3$ and is used in the preferred embodiment of this invention. It will be understood to those skilled in the art that the electrodes may comprise a tissue equivalent plastic such as A-150 plastic.

The electrode 12 in the preferred embodiment is oblong and has a length of 1.6 cm. The center electrode 14 is also oblong in shape and has a radius of 0.1 cm. The electrodes 12 and 14 are separated by an air gap 16 and together form a thimble chamber 18. The outside radius of the thimble chamber 18 in the preferred embodiment is 0.5 cm.

Each of the electrodes 12 and 14 are electrically connected to a high voltage power supply 19 by conductor 20. A further electrical conductor 22 is provided to the center electrode 14 for detecting current generated within the air gap 16 as a result of exposure to radiation rays. The current signal indicative of the dosage of radiation received by the thimble chamber 18 may be monitored from the electrical conductor 22 by an appropriate electrometer. The electrical conductor 22 is electrically shielded from the high voltage source 19 by insulation 23.

In accordance with the present invention, the ionization chamber 10 has zero displacement in a water phantom as a result of the thimble 18 having an equivalent density of approximately 1 gm/cm$^3$ substantially equal to water. The electrodes 12 and 14 are configured by dimension and density such that radiation waves, such as x-rays and gamma rays, incident to the thimble 18 weighted by normal radiation path lengths to the center of the chamber produce no missing water phantom. Thus, the chamber-dependent displacement factor may be substantially ignored since it has the effect of a zero displacement or a displacement factor of unity. It is to be understood that the dimension and density parameters disclosed for the preferred embodiment are only examples of the combination of the shape and density configuration of the thimble chamber to effect a zero displacement ionization chamber. The shape and density of the electrodes 12 and 14, as well as the size of the air gap 16, may change to effect an overall density of the thimble chamber 18 to be substantially equal to water.

Figure 2:
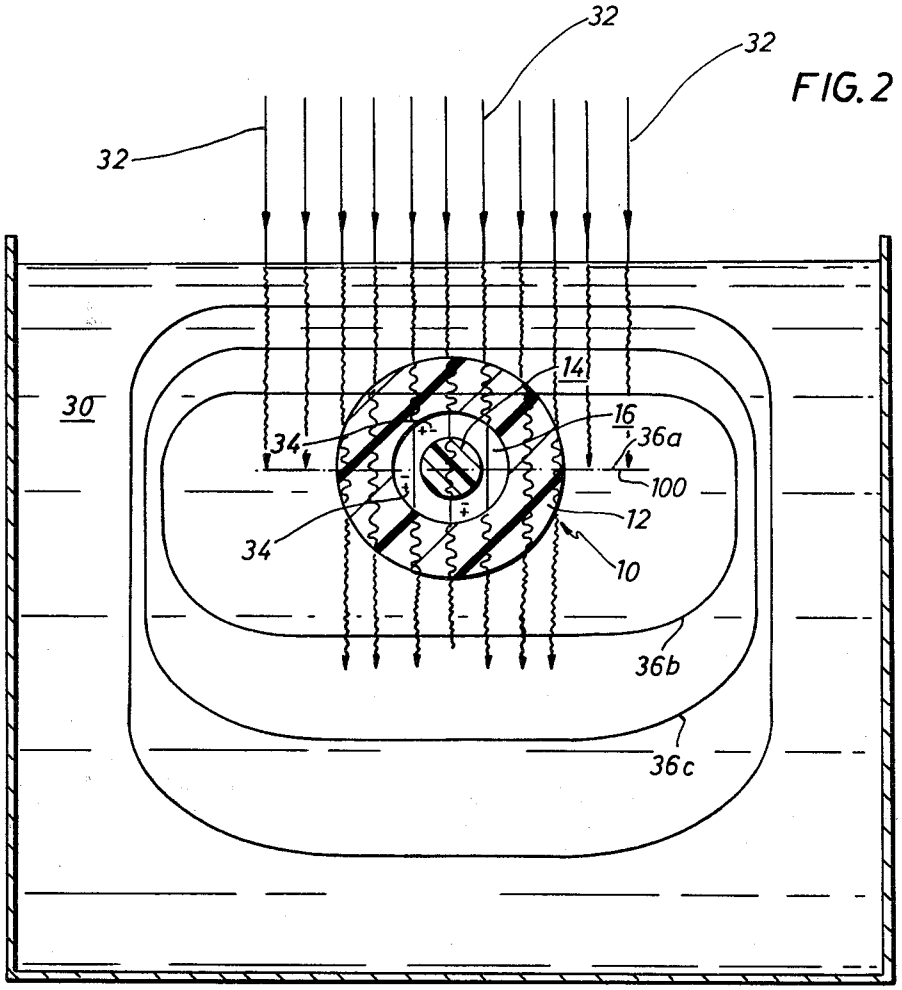
FIG. 2 illustrates a front section view of the FIG. 1 taken at lines 2—2, of a zero displacement ionization chamber used in a water phantom calibration system.

FIG. 2 illustrates an ionization chamber 10 submerged in a water phantom 30. A radiation source, (not shown), disperses a series of radiation rays 32 incident to the ionization chamber 10. As can be seen from the figure, as the radiation penetrates the water phantom 30, there is an attenuation in the radiation ray based upon the density of the medium it is passing through. The chamber wall, which is in effect the electrode 12 shown in FIG. 1, is comprised of a material having a density greater than water. Therefore, the attenuation through the electrode 12 and the central electrode 14 will be greater than the attenuation through the water phantom 30. However, as is further illustrated in the drawing, some radiation rays 32 must also pass through the air gap 16. The density of air may be taken to be substantially zero and thus will not attenuate the passing radiation rays 32. As stated above, the combination of the dimensional relationship of the electrodes 12 and 14 with the air gap 16 will effect an attenuation factor through the ionization chamber 10 to be substantially equivalent to the attenuation factor through the water phantom 30 to the same point. Thus, the radiation detected at the central electrode 14 will be representative of the radiation exposure to the water phantom 30.

Operationally, the ionization chamber 10 is placed in a water bath and adapted to receive radiation rays 32. With both the electrodes 12 and 14 electrically connected to a high voltage power supply, the radiation rays 32 will cause an ionization of the air in the air gap 16 while passing through the thimble chamber 18. This ionization will result in a series of charged particles 34 present in the air gap and shown in the form of + and − signs on the drawing. These charged particles 34 will be attracted to the electrode of opposite polarity to the particles. This attraction will result in an induced current in the central electrode 14 that is proportional to the radiation dosage received at that point in the water phantom 30.

It is known that the maximum radiation dosage for Cobalt-60 radiation will be incurred at approximately 0.5 centimeters below the surface of the phantom. Therefore, a further dimension of the ionization chamber in the preferred embodiment is an outside radius of 0.5 centimeters. This will allow the ionization chamber to be placed directly below the surface of the water phantom 30 and have the central electrode 14 in a position 0.5 centimeters below the surface which will be the point of maximum exposure of the radiation wave 32. The FIG. 2 further illustrates isodose curves 36*a–c* which are indicative of the percentage of exposure of the radiation waves through the water phantom 30. It will be noted that the isodose curve 36*a* at 100% exposure is coincident with the center of the thimble chamber 18 which is positioned to receive the maximum radiation exposure.

Figure 3:
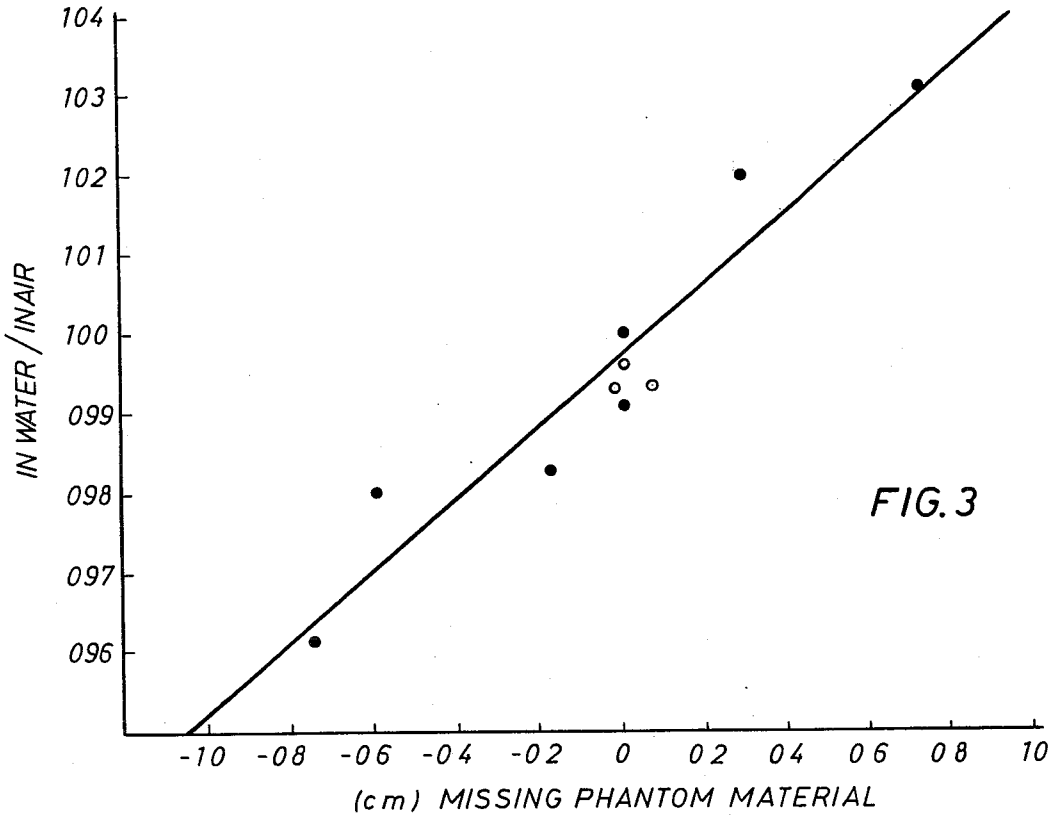
FIG. 3 is a graphical representation of displacement as a function of missing phantom material.

FIG. 3 graphically represents the relationship of the displacement in a water or air phantom versus missing phantom material. The missing phantom material is that amount of phantom material that is displaced as a result of the change in densities of material that the radiation must pass through to get to the detection point. As can be seen from the graph, there is the possibility of both positive and negative missing phantom material resulting in a displacement factor greater than unity and a displacement factor less than unity, respectively. In both instances, the presence or absence of missing phantom material will result in an error in the calibration of the radiation therapy unit. Thus, it is most desirable to have zero missing phantom material, which will yield a result of a unity displacement factor that may be ignored in any calibration of radiation therapy units using ionization chambers in a water phantom.

While the present invention has been described and illustrated with respect to a preferred embodiment, it will be understood by those skilled in the art that many changes and modifications may be made that are contemplated to be within the scope of the present invention as defined in the following claims.

What is claimed is:

1. A displacement-free ionization chamber comprising:

a thimble chamber comprising:

a first electrode;

a second electrode spaced from said first electrode by a predetermined air gap, each of said first and second electrodes electrically connected to a voltage power supply;

said first and second electrodes comprising a material density balanced with said air gap density for producing an overall thimble chamber density substantially the density of water, whereby said chamber has an effective zero displacement when submerged in water; and means for electrically connecting said first and second electrodes to a voltage power supply.

2. A displacement-free ionization chamber comprising:

a thimble chamber including:

a first electrode of a generally cylindrical shape;

a second electrode having a substantially cylindrical shape, different in size from said first electrode, said second electrode spaced from said first electrode by a predefined air gap;

said first and second electrodes comprising a material density balanced with the air in said air gap for producing an overall thimble chamber density proportional to the weighted density of the material and air by normal radiation path lengths to said chamber, wherein the density of said chamber is substantially the density of water, such that said ionization chamber has an effective zero displacement when submerged in water; and means for electrically connecting said first and second electrodes to a voltage power supply.

3. A displacement-free ionization chamber as set forth in either of claims 1 or 2, wherein said second electrode is partially enclosed by said first electrode and separated therefrom by said air gap.

4. A displacement-free ionization chamber as set forth in either of claims 1 or 2, wherein said means for electrically connecting said first and second electrodes to said power supply comprises an electrical conduit.

5. A displacement-free ionization chamber as set forth in either of claims 1 or 2, wherein said power supply is a high voltage power supply.

6. A displacement-free ionization chamber as set forth in either of claims 1 or 2, further including electrical signal means connected to said second electrode for detecting a current signal proportional to radiation ray exposure to said chamber.

7. A displacement-free ionization chamber as set forth in either of claims 1 or 2, wherein the outside radius of said thimble equals 0.5 centimeters.

8. A displacement-free ionization chamber as set forth in either of claims 1 or 2, wherein said first electrode has a thickness of 0.22 centimeters, and length of 1.6 centimeters.

9. A displacement-free ionization chamber as set forth in either of claims 1 or 2, wherein said first and second electrode material comprises conducting plastic.

10. A displacement-free ionization chamber as set forth in claim 9, wherein said conducting plastic is tissue equivalent A-150 plastic.

11. A displacement-free ionization chamber as set forth in claim 9, wherein said conducting plastic is air equivalent C-552 plastic having a density of 1.76 $gm/cm^3$.

12. A displacement-free ionization chamber as set forth in either of claims 1 or 2, wherein said second electrode has a radius of 0.1 centimeters.

13. In a displacement-free ionization chamber comprising:

a thimble chamber including:

a first electrode having a predetermined thickness and length;

a second electrode having a predetermined thickness and length separated from said first electrode by a predefined air gap;

wherein said first and second electrodes and said air gap are shape and density balanced by weighting the normal path lengths of radiation rays through said thimble chamber, thereby effecting a thimble chamber having an overall density substantially the same as water yielding a zero displacement when placed in water.

* * * * *